United States Patent [19]

Taguchi et al.

[11] Patent Number: 4,722,275

[45] Date of Patent: Feb. 2, 1988

[54] WEB TENSION CONTROL APPARATUS FOR USE WITH A ROTARY PRESS

[75] Inventors: Toshio Taguchi; Hitoshi Matsuoka, both of Hiroshima, Japan

[73] Assignee: Mitsubishi Jukogyo Kabushiki Kaisha, Tokyo, Japan

[21] Appl. No.: 871,437

[22] PCT Filed: Oct. 9, 1985

[86] PCT No.: PCT/JP85/00560

§ 371 Date: May 27, 1986

§ 102(e) Date: May 27, 1986

[87] PCT Pub. No.: WO86/02339

PCT Pub. Date: Apr. 24, 1986

[30] Foreign Application Priority Data

Oct. 12, 1984 [JP] Japan ..... 59-212606
Oct. 15, 1984 [JP] Japan ..... 59-154343

[51] Int. Cl.[4] ..... B41F 5/06; B65H 23/14; B65H 23/188

[52] U.S. Cl. ..... 101/228; 101/181

[58] Field of Search ..... 101/228, 226, 181, 178; 226/195, 193, 38, 34, 45

[56] References Cited

U.S. PATENT DOCUMENTS 3,098,432 7/1963 Bechtold et al. ..... 101/181 X
4,004,510 1/1977 Roch ..... 101/228
4,096,801 6/1978 Martin ..... 101/228

FOREIGN PATENT DOCUMENTS 39-28689 9/1964 Japan .
54-116560 9/1979 Japan .
59-104939 6/1984 Japan .

OTHER PUBLICATIONS

Nippon Shinbun Kyokai Komu Iinkai-hen, "Shinbun Insatsu, Insatsu-hen Kaitei ban" Oct. 31, 1980, Shadan Hojin Nippon Shinbun Kyokai, pp. 214–215, FIG. 57, p. 281, FIG. 46.

*Primary Examiner*—J. Reed Fisher
*Attorney, Agent, or Firm*—Wenderoth, Lind & Ponack

[57] ABSTRACT

The web tension control apparatus according to the present invention is provided with a biasing roller (6) adapted to be urged against the outer circumferential surface of a midway drag roller (4), a biasing means (7) adapted to apply an urging force in the biasing direction against the biasing roller (6) for the midway drag roller, a tension detecting means (7), (9) adapted to detect the tension of a running web (1) upstream and downstream of a printing unit (2), and a control means (10) adapted to control the urging force of the biasing device 7 in accordance with the signals from the tension detecting means (7), (9). If there is any difference in the signals from the tension detecting means (7), (9), the control device (10) controls the biasing roller (6) for the midway drag roller (4) by the aid of the biasing device (7) so as to eradicate the difference in the signals, so that the tensions web upstream and downstream of the printing unit (2) are equal with each other. Any losses of the tension in the web (1) as generated in the slotted section of a printing cylinder may be prevented from occurring, and any variations in the tensions of the web (1) may be relieved substantially so that defects in the printing such as the offset doubles and the deviations in cutting the printings, etc. may be obviated accordingly.

3 Claims, 6 Drawing Figures

FIG. 1
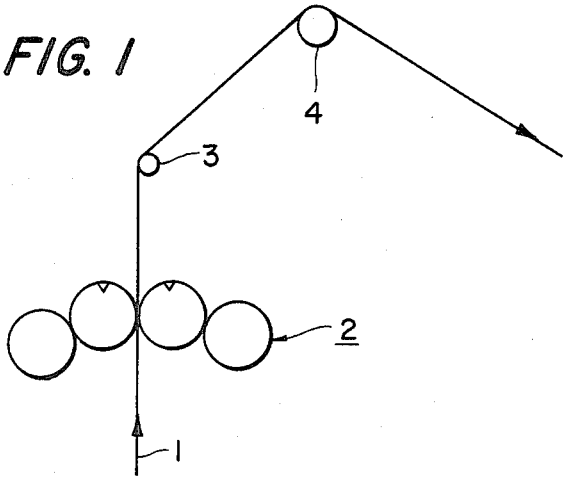
FIG. 2
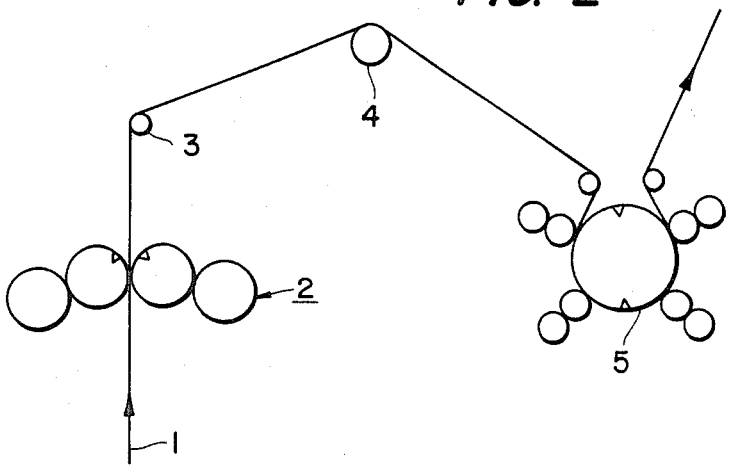
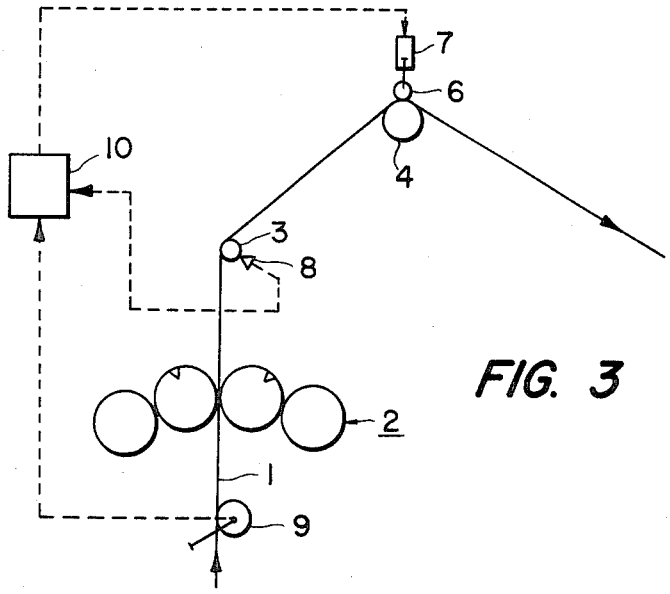
FIG. 3

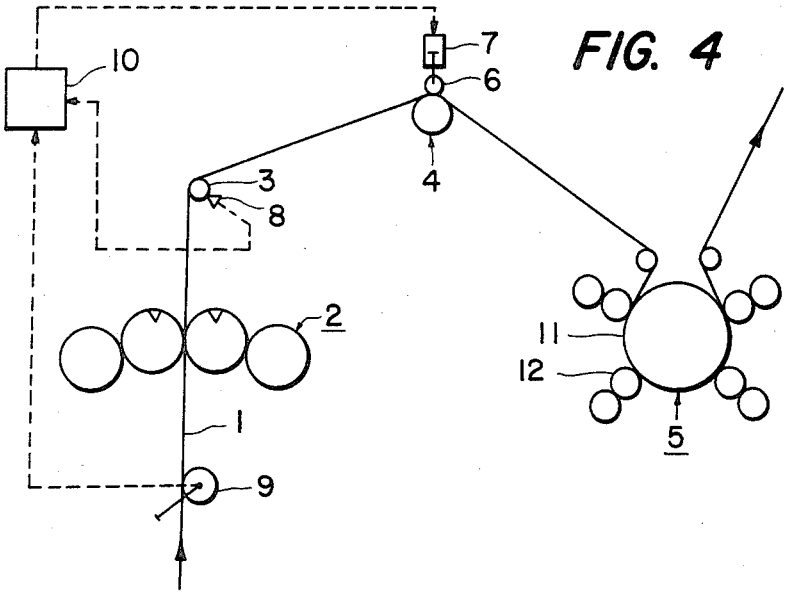
FIG. 4
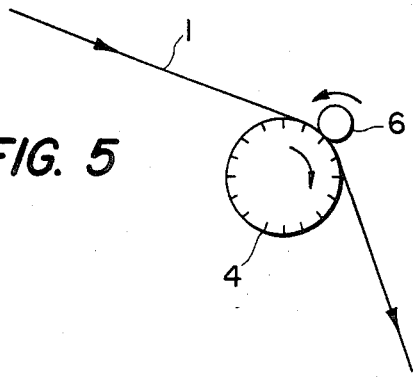
FIG. 5
FIG. 6
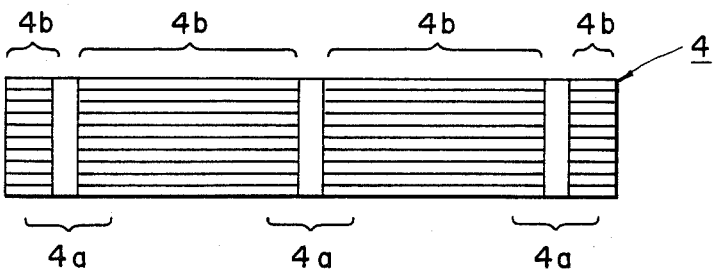

WEB TENSION CONTROL APPARATUS FOR USE WITH A ROTARY PRESS

BACKGROUND OF THE INVENTION

1. Field of the Invention

The present invention relates to an apparatus for controlling the tension of a running print sheet or web for use with a rotary press.

2. Description of the Related Art

A typical monochromatic perfecting unit and of a typical monochromatic perfecting and multicolor one-side printing unit for use with a conventional rotary press are shown in FIG. 1 and FIG. 2, respectively. According to the monochromatic perfecting unit as shown in FIG. 1, a running printing sheet or web of paper 1 is, after having been printed by the monochromatic perfecting unit 2, directed through a guide roller 3 toward a midway drag roller 4, whereby the web of paper is subjected to traction to be delivered to following operations.

According to the monochromatic perfecting unit and the multicolor one side printing unit as typically shown in FIG. 2, the running web 1 is, after having been printed by the monochromatic perfecting unit 2, directed through a guide roller 5 toward a midway drag roller 4, whereby the web is subjected to traction to be delivered to a multicolor one side printing unit 5, where the web is subjected to the multicolor printing operations and is then redirected to following procedures in the printing line.

In the construction of the rotary press as schematically shown in FIGS. 1 and 2, it is observed that there occurs a substantial variation in tension of the running web 1 extending in the upstream and downstream of the monochromatic perfecting unit 2 and the multicolor one-side printing unit 5. This variation in tension of the web is considered to result from the possible loss of tension by way of the slots of the printing cylinder and of vibrations occurring per one operating cycle of the printing cylinder, and such variations in tension result in such faults such as deviations in the cutting of the printings and such as offset doubles, or the like.

SUMMARY OF THE INVENTION

In consideration of such problems as noted above, it is an object of the present invention to provide a tension control apparatus for use with a rotary press which can prevent the faults in the conventional printing units such as the occurrence of offset doubles and the deviation in the cutting of the printings, by eliminating possible variations in the tension of a running printing sheet or web upstream and downstream of the printing units incorporated in the rotary press line.

According to the invention, there is provided a tension control apparatus for use with a rotary press, which comprises, as briefly summarized, a midway drag biasing roller adapted to be urged resiliently against the outer circumferential surface of a midway drag roller, a biasing device adapted to resiliently apply an urging pressure upon the midway drag biasing roller so that it may be urged properly in the biasing direction, a tension detecting device adapted to detect the tensions of the printing sheet or web extending upstream and downstream of a printing unit, and a control device adapted to control the urging force of the biasing device in accordance with due signals from the tension detecting device, so that the tensions of the running web upstream and downstream of the printing unit may be equalized, whereby there is attained such advantageous effects such as preventing a loss of tension in the printing web as would be encountered in the area of the slotted section of a printing cylinder, and such as reducing possible variations in the tension of the running web, thus resulting in the efficient prevention of defects such as offset doubles and variations in the cutting of the printings.

The present invention will now be described by way of preferred embodiments thereof taken with reference to the accompanying drawings.

BRIEF DESCRIPTION OF THE DRAWINGS

FIGS. 1 and 2 are schematic views show portions of conventional printing units;

FIG. 3 is a schematic view showing the system of a tension control apparatus by way of a preferred embodiment of the present invention for use with a rotary press;

FIG. 4 is a schematic view showing the system by way of another embodiment of the present invention;

FIG. 5 is a schematic side elevation view showing a preferred embodiment of a midway drag roller of the present invention; and FIG. 6 is an enlarged front elevation view showing the midway drag roller of the present invention.

DESCRIPTION OF THE PREFERRED EMBODIMENT

A tension control apparatus according to the present invention for use with a rotary press shown in FIG. 3 is now described by way of a preferred embodiment, which is shown comprising a running sheet or web of printing paper designated at the reference numeral 1, a monochromatic perfecting unit at 2, a guide roller at 3, a midway drag roller at 4, a biasing roller at 6 which is not rotatably driven resiliently urged toward the midway drag roller 4, and a biasing device at 7 for causing the biasing roller 6 to be biased under a biasing force against the midway drag roller 6. Also, a tension detector 8 is provided in the guide roller 3, and a floating or dancer roller 9 is provided upstream of the monochromatic perfecting unit 2. The detection of the tension in the running web 1 passing through the monochromatic perfecting unit 2 and the guide roller 3 is conducted in such a manner that a signal representing the tension detected as a load rendered by the dancer roller 9 upstream of the monochromatic perfecting unit 2 and a signal representing the tension as detected by the tension detector 8 are fed to a control unit 10 which is adapted to control the biasing device 7.

Now, referring to the operation of the web tension control apparatus for use with the rotary press shown in FIG. 3, the running web of printing paper 1 is directed to extend toward to the monochromatic perfecting unit 2, the web 1 being tensioned upstream of the unit 2, and thereafter fed into the unit 2 for printing. After printing, the running web 1 is then directed to pass through the guide roller 3, where the tension of the web 1 on the delivery side of the monochromatic perfecting unit 2 is detected by the tension detector 8 which is provided in the guide roller 3, and then is sent out to the midway drag roller 4. It is arranged so that the outer circumferential speed of the midway drag roller 4 is set to be 1% greater than that of the monochromatic perfecting unit 2, and that the midway drag roller 4 slips with respect to the web 1 to an extent of a difference in the speeds of the two. With this arrangement, the midway drag roller 4 may render a dragging or friction force which is generally proportional to the biasing force of the biasing roller 6 upon the web 1, so that the tension of the web 1 may be controlled exclusively in accordance with the biasing force from the biasing roller 6, accordingly.

If the tension signal which is detected by the dancer roller 9, for example a voltage signal, and the tension signal as detected by the tension detector 8, for example a voltage signal, are each proportional to the detected tension of the web 1, and these signals are fed into the control device 10, where they are compared with each other for any difference in magnitide of voltage, and if any, the control device 10 functions to generate a control signal which compensates for the difference in these signals, the control signal of the control device 10 is delivered to the biasing device 7 so that the biasing roller 6 may render an appropriate biasing force upon the midway drag roller 4 so as to control the tension of the web 1 accordingly. For instance, if the current tension as detected in the web 1 after passing the monochromatic perfecting unit 2 is found smaller than that upstream of the unit 2, the biasing device 7 is operated to urge the biasing roller 6 so as to increase the tension in the web 1, and vice versa. With such a tension control operation, the tensions present in the web 1 before and after passing through the monochromatic perfecting unit 2 are efficiently regulated to be equal to each other. Once the difference in the tensions in the web 1 across the monochromatic perfecting unit 2 is eliminated, there is no longer a chance of tension losses at the slotted section of the print cylinder, thus relieving possible variations in the tension of the web 1 and thus preventing defects such as the offset doubles, and deviations in cutting the printings, etc. from occurring.

FIG. 4 shows another embodiment of the invention which is adapted to the rotary press employing the monochromatic perfecting unit 2 and the multicolor one-side printing unit 5 shown in FIG. 2.

According to the construction of the multicolor one-side printing unit 5 shown in FIG. 4, a plurality of sets of blanket cylinders 12 are urged toward the outer circumference of an impression cylinder 11. With such an arrangement, should a loss of tension in the web 1 by the slotted section in the printing cylinder occur while the web is held and fed in a sandwiched relationship between the impression cylinder 11 and the blanket cylinders 12, since some sets of blanket cylinders 12 may still serve to efficiently hold the web 1 in position around the circumference of the impression cylinder 11, only relatively small tension losses occur from the slotted section in the printing cylinder, thus efficiently preventing such faults in the printing from occurring as accomplished with the advantageous construction shown in FIG. 3, accordingly.

Next, referring to a preferred embodiment of the midway drag roller 4 shown in FIGS. 5 and 6, a running web of printing paper 1, a midway drag roller 4 having a flat portion **4*a* with a flat circumferential surface and a groove portion 4*b* formed with a plurality of grooves extending parallel to each other and disposed in alternate fashion with the flat portion, and a biasing roller 6 adapted to urge the web 1 upon the flat portions 4*a* of the midway drag roller 4** are provided.

Now, the operation of the midway drag roller 4 as shown in FIGS. 5 and 6 will be described. It is seen that the web 1 is urged against the outer circumferential surface of the midway drag roller 4 by the biasing roller 6 while passing therethrough, with an appropriate tension value to following operations. At this stage, the web 1 would possibly proceed in zigzag manner with a too large of a tension rendered, which would result in a breakage of and wrinkle in the web 1. In this respect, it is required to maintain an appropriate tension within an optimal range. According to this embodiment, by virtue of such a unique construction of the midway drag roller 4 which is provided the flat portions **4*a* and the grooved portions 4*b* disposed in an alternate manner so that there are formed a plurality of grooves extending in parallel and in the circumferential direction in the outer circumferential surface of the roller 4, there is attained such an advantageous effect that the grooved portions 4*b* in the roller surface may let air entrapped by the web 1 escape, thus preventing the loss of frictional drive force from the circumferential surface of the midway drag roller 4 from occurring and thus, the biasing roller 6 serves to effiently urge the web 1 upon the flat portions 4*a* thereof so that the tension of the web 1 may be controlled optimally. Incidentally, it is empirically known that when the outer circumference of the midway drag roller 4** is made partly flat, the coefficient of friction is reduced merely from a few percent to tenths of a percent in comparison with a drag roller which is provided with a plurality of grooves in the entire circumferential area of thereof.

As reviewed fully hereinbefore, with the improved construction such that the midway drag roller 4 is designed with its outer circumferential surface comprising the plurality of flat portions **4*a* sandwiched between the adjacent grooved portions 4*b* extending parallel to one another in the circumferential direction, and the biasing roller 6 is urged toward the flat portions 4*a* of the midway drag roller 4 so that the biasing roller 6 may serve to urge the flat portions 4*a* of the midway drag roller 4 through the running web 1 sandwiched therebetween, there is no possibility that the grooves will leave any undesired marks or impressions on the surface of the web 1 even with a substantial urging force rendered thereupon, thus making it feasible in practice to have a substantially widened range of tension control for the running web 1 in comparison with the conventional construction in which there are formed a plurality of grooves the entire outer circumferential area of the drag roller 4. Also, it provides another advantageous feature in that the running web 1 may be held in an optimal condition while being fed along the printing line because it ensures that the web 1** is free from any marks of grooves in the urging roller.

We claim:

1. A web tension control apparatus for a rotary press having a rotating printing unit through which the web passes, comprising:

a midway drag roller downstream of the printing unit and over which the web travels, and means for driving the midway drag roller so as to have a circumferential speed that is slightly higher than that of the rotating printing unit for causing the midway drag roller to slip with respect to the web travelling thereover to an extent corresponding to the difference in the circumferential speeds of the midway drag roller and the printing unit;

a biasing roller adjacent the outer circumferential surface of the midway drag roller at a location at which the web travels over the midway drag roller, and a biasing means for applying an urging force in a biasing direction against said biasing roller for urging the biasing roller toward the outer circumferential surface of the midway drag roller to press the web against said midway drag roller at said location;

a tension detecting means for detecting the tension of the web upstream of the printing unit, for detecting the tension of the web downstream of the printing unit, and for issuing a signal indicative of the detected tensions; and a control means operatively connected between said biasing means and said tension detecting means for receiving the signal from said tension detecting means and for controlling the urging force imparted by said biasing means to the biasing roller in accordance with the signal received.

2. An apparatus as claimed in claim 1, wherein said midway drag roller comprises a plurality of flat portions and grooved portions alternately disposed around the outer circumferential surface, the grooved portions each having a plurality of grooves extending parallel to one another, and said biasing means is for urging the biasing roller toward the outer circumferential surface of the midway drag roller to press the web against the flat portions of the midway drag roller.

3. An apparatus as claimed in claim 1, wherein said control means controls the urging force imparted by said biasing means for regulating the tension of the web downstream of the printing unit to a predetermined value in comparison with tension of the web upstream of the printing unit as detected by said tension detecting means.

* * * * *